US005799795A

United States Patent [19]

Mease

[11] Patent Number: 5,799,795

[45] Date of Patent: Sep. 1, 1998

[54] LAP TRAY

[76] Inventor: Richard B. Mease, 7829 N. Applegate Rd., Grants Pass, Oreg. 97527

[21] Appl. No.: 843,565

[22] Filed: Apr. 18, 1997

[51] Int. Cl.[6] ..... B65D 1/34

[52] U.S. Cl. ..... 206/564; 220/17.1; 220/17.2

[58] Field of Search ..... 206/216, 564, 206/557; 220/17.1, 17.2; 224/400, 453, 276, 42.12, 42.13; 248/313; 108/43, 45; D6/406

[56] References Cited

U.S. PATENT DOCUMENTS

| | | | |
|---|---|---|---|
| D. 286,711 | 11/1986 | Roczey | D6/406 |
| 2,647,678 | 8/1953 | Olson | 220/17.1 |
| 3,804,233 | 4/1974 | Gregg, Jr. | 206/387.15 |
| 3,942,671 | 3/1976 | Florian | 206/564 |
| 4,219,144 | 8/1980 | Hagelberg | 206/564 |
| 4,986,433 | 1/1991 | Davis | 206/564 |
| 5,335,787 | 8/1994 | Finchum et al. | 206/564 |
| 5,355,811 | 10/1994 | Brewer | 108/43 |
| 5,421,459 | 6/1995 | Mazzotti | 206/564 |
| 5,520,119 | 5/1996 | Eisenberg | 108/43 |

*Primary Examiner*—David T. Fidei

*Attorney, Agent, or Firm*—Natan Epstein of Beehler & Pavitt

[57] ABSTRACT

A lap tray for use by a sitting person has a base plate, an upright midportion rising from the base plate and a tray attached to the upper end of the midportion. In use the base plate is held down under one thigh of the person, the midportion between the thighs, and the tray rests on the other thigh. Food and beverage receptacles may hang from the tray portion to one side of the person, allowing for unobstructed use of the tray in an automobile by a driver sitting behind a steering wheel.

22 Claims, 1 Drawing Sheet

LAP TRAY

BACKGROUND OF THE INVENTION

1. Field of the Invention

This invention relates generally to trays of the type used for supporting food and beverages, or other articles, on the lap of a seated person.

2. State of the Prior Art

Motorists and their passengers frequently find it desirable and convenient to purchase food and beverages from roadside fast food outlets for consumption in their vehicles. Fast food vendors typically sell the food and beverages in disposable packaging such as paper bags, paper cups, Styrofoam containers, and aluminum cans. Once in his or her vehicle, the motorist usually lacks a convenient surface on which to place the food and beverage while the same is consumed. Although many recent model vehicles are equipped with cup holders for beverage containers, these may be limited to a particular cup size and may not, for example, hold the large size soft drink cups typically sold at fast food outlets. Food packages in paper bags or Styrofoam containers may simply have to be balanced on the person's lap while the contents are consumed in the vehicle. In a moving vehicle, holding food or drink on the lap of the driver is likely to interfere with operation of the vehicle and constitutes a dangerous distraction. The steering wheel of the motor vehicle normally extends over the driver's lap, leaving little space for holding food or drink, even in a stationary vehicle. Placing the food on improvised dining surfaces such as a center console or a dashboard is inconvenient and awkward, and risks spilling of the contents of such containers as a result of shaking and acceleration of the moving vehicle.

Similar difficulties are encountered wherever food or beverage are consumed by persons seated away from a table, as for example, persons seated on a couch while viewing television, persons seated on benches at outdoor or indoor public events such as sports games, and many other similar situations.

A continuing need exists for dependable lap trays suitable for low cost, high volume production from preferably recyclable, disposable materials, capable of supporting food and beverage within convenient reach and safely containing the food and beverage against spillage under challenging environmental conditions such as in a moving motor vehicle or a windy outdoor location.

BRIEF SUMMARY OF THE INVENTION

The present invention provides a lap tray for use by a person seated on a seat surface. The lap tray has a tray portion connected by a midportion to a base portion. The midportion supports the tray portion elevated above and offset to one side of the base portion,. in non-overlying relationship to the base portion, so that the tray portion and the base portion are on opposite sides of the midportion, and the tray is cantilevered on the midportion. The lap tray is configured such that, in use, the base portion is captured under one thigh of the seated person, the midportion has a lower end connected to one side of the midportion and rises between the two thighs, and the tray portion is supported at an upper end of the midportion generally horizontally and to one side of the seated person. The weight of the tray portion and its contents are counterbalanced by the weight of the thigh holding down the base portion against the seat.

The base portion may be a planar relatively thin sheet portion, and the midportion may be a curved portion with a semi-cylindrical concave underside shaped to generally conform to the curvature of the user's thigh. The concave underside may extend about ninety degrees of arc between the a lower end of the midportion and the tray top. The midportion preferably has a width dimension which is at least half the width of the tray portion, i.e. has a width much greater than its thickness, providing a relatively wide and stable support for the tray portion. The tray portion may be sized and shaped to suit any desired use, and may have one or more receptacles dependent from a tray top and defining cavities for holding specific items in place. The receptacles are laterally spaced from the concave underside of the midportion to define therebetween a space dimensioned for receiving the height and width of a thigh of the seated person, so that the tray portion is supported on the one thigh while the base portion is captive under the other thigh of the seated person, with the midportion rising between the thighs. The tray top may include a generally planar portion overlying the thigh receiving space between the midportion and the receptacles. Such receptacles may include one or more food holding cavities and beverage container receptacles. In a presently preferred tray configuration a cup holder receptacle and a food holding cavity larger than the cup holder receptacle are provided. The cup holder receptacle is partly open to the holding cavity such that a beverage container with a handle, such as a coffee mug, may be placed in the receptacle with the handle conveniently extending into the larger holding cavity.

The receptacles of the tray portion may have a tray bottom normally suspended just above a plane defined by the base portion, such that in an unloaded condition the tray bottom hangs a relatively small height above the plane occupied by the base portion of the lap tray, and in a loaded condition of the tray the midportion may flex so that the tray bottom comes to rest on the seat surface. That is, the receptacles normally depend a vertical distance which is a little less than the vertical distance from the tray top to the base plane and in a loaded condition the receptacles depend from the tray top to the base plane. The tray bottom may slope downwardly and away from the midportion towards a lowermost portion at an outer end of the tray, so that the lowermost portion rests on the seat surface under sufficient loading of the tray when in use. The sloping bottom drains spilled liquids toward one end of the holding cavity and inclines food packages for easier access.

The base portion and the midportion may be formed of a continuous sheet bent and joined at an approximately right angle bend of the continuous sheet. The lap tray of this invention may be advantageously formed as a unitary tray of injection molded or vacuum formed plastic or the like.

These and other advantages, features and improvements will be better understood from the following detailed description of the preferred embodiment and the accompanying drawings.

DETAILED DESCRIPTION OF THE PREFERRED EMBODIMENT

Figure 1:
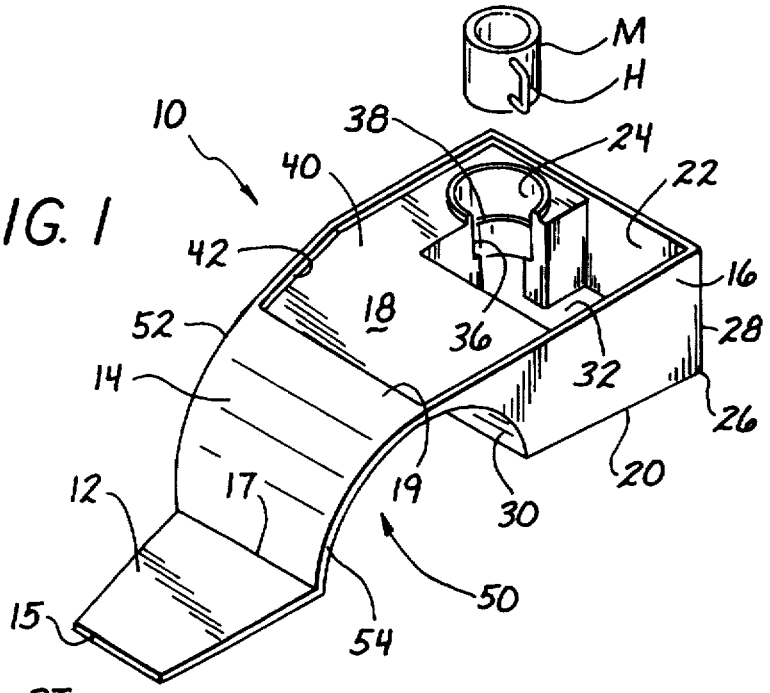
FIG. 1 is a top side perspective view of a lap tray according to this invention.

With reference to the drawings, a lap tray according to this invention is generally designated by the numeral 10. The lap tray 10 has three main portions, all formed integrally with each other by, for example, injection molding or vacuum forming of a relatively rigid thermoplastic or rigid synthetic foam. The three main portions are a flat base portion 12, an arcuate midportion 14 and a generally rectangular tray portion 16 with a number of holding cavities. The base portion is a thin flat plate with a free edge 15 and an opposite edge connected to the lower end 17 of the midportion 14. The base portion and the midportion are joined along a right angle bend of a continuous sheet of thin material. The arcuate midportion 14 begins as a relatively thin sheet rising from the base plate 12 and increasing in thickness as it curves away from the base plate 12 towards a top 19 where it joins one side of the tray portion 16. The tray portion 16 has a top surface 18 supported horizontally at the upper end of the midsection in laterally offset non-overlying relationship with the base plate 12, as best understood by reference to FIGS. 1 and 3. As shown, the tray portion 16 and the base plate 12 extend away from each other each entirely on an opposite side of the midportion 14. That is, the base plate 12 is held down only under the left thigh LT, while the tray portion 16 is supported only on the right thigh RT. Between the base plate 12 and the tray portion 16, the midportion 14 has a concave, semi-cylindrically curved underside 30, best seen in FIG. 3, which extends approximately ninety degrees of arc. A holding receptacle or cavity 22 and a beverage container receptacle 24 are defined in the tray top surface 18 of the tray portion.

Figure 2:
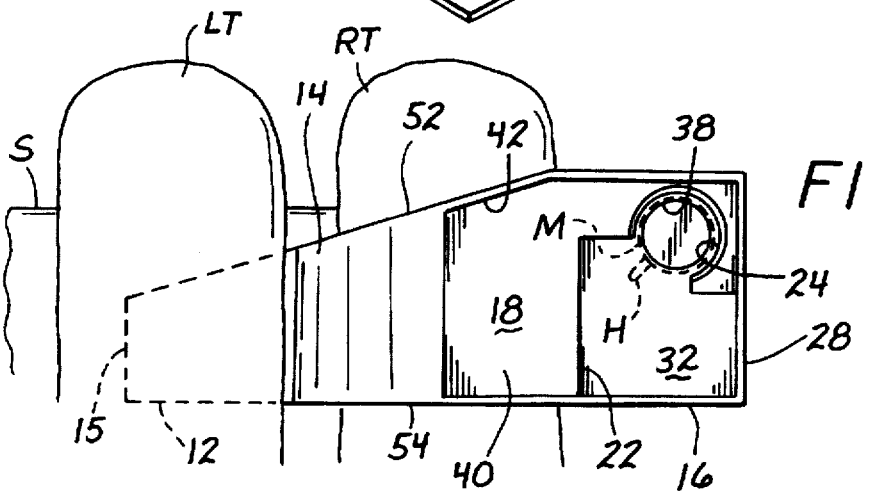
FIG. 2 is a top plan view of the lap tray of FIG. 1 in use on the lap of a seated person.
Figure 3:
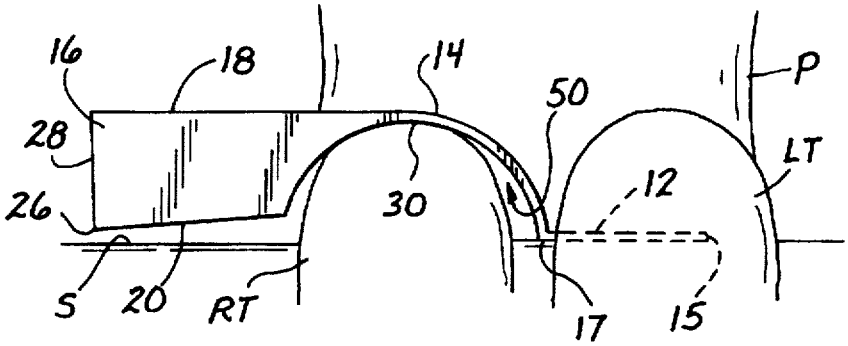
FIG. 3 is a front elevational view of the lap tray positioned as in FIG. 2.

The lap tray 10 is intended for use by a person P seated on a seat surface S in the manner illustrated in FIGS. 2 and 3. The receptacles 22, 24 depend from the tray top 18 to a level which is just above a base plane defined by the base plate 12, and which in effect is the seat surface S. That is, the receptacle 22 hangs a vertical distance which is a substantial portion or nearly equal to the vertical height of the midportion measured from the tray top 18 to the base plate 12, as best understood by reference to FIG. 3. The curved underside 30 of the midportion faces the receptacles 22, 24 which are spaced laterally from the curved underside 30 of the midportion to define a thigh receiving space 50 which extends from front 52 to rear 54 of the lap tray 10. The thigh receiving space 50 has a width and a height dimensioned for receiving the height and width of the user's thigh RT as shown in FIGS. 2 and 3. As seen in FIG. 2 the underside 30 of the midportion 14 and the depending receptacles 22, 24 of the tray portion 16 fit rather closely over and on either side of the thigh RT, with a planar portion 40 of the tray top 18 overlying the thigh RT. Also, it will be appreciated from the drawings that the arcuate midportion 14 is relatively wide, i.e has a width between the tray front 52 and tray back 54 which is at least half the width of the tray portion 16 and is much wider than the thickness of the midportion, providing stable and comfortable support on the user's thigh RT.

The arcuate midportion 14 is placed over the right thigh RT of the user while the base plate 12 is captured under the left thigh LT and held down by the weight of the left thigh against the seat surface S. The tray portion 16 in part overlies the thigh receiving space 50 as well as the curved underside 30 which lies across the right thigh RT of the user P, and extends in part to the right or the outside of the right thigh RT of the user so that the dependent receptacles 22, 24 hang to one side of the user P, and the user's lap is clear and unobstructed by the receptacles. Conversely, access to the receptacles is unobstructed by anything in front of the user, such as the steering wheel of an automobile. The tray portion is in effect cantilevered on the midportion 14 and the weight of the tray portion is carried on the right thigh RT. The lowermost edge 26 of the tray bottom 20 normally hangs slightly above the seat surface S which in FIG. 3 is coextensive with an extended, imaginary base plane defined by the base plate 12.

The holding cavity 22 is generally rectangular with a holding cavity bottom 32, and the cavity 22 has a depth nearly equal to the exterior height of the tray portion 16. One corner of the tray portion is occupied by a generally cylindrical beverage container receptacle 24 which partially overlaps with the holding cavity 22 to define a side opening 36 between the container receptacle and the holding cavity. The side opening 36 extends about ninety degrees of arc of the cylindrical side wall of receptacle 24, as best understood from FIGS. 1 and 2. The receptacle 24 is two tiered in that a midlevel annular lip 38 is sized to support the bottom of a standard sized mug-type beverage container, while standard sized 12 oz. beverage cans as well as paper or plastic cups may fit past the lip 38, up to the full depth of the receptacle 24 which reaches the same bottom 32 as the holding cavity 22. FIG. 1 shows a typical conventional mug-type beverage container M with a holding handle H. When the mug is placed into the receptacle 24, handle H is accommodated by the side opening such that the handle H extends in a radial direction from the receptacle 24 into the holding cavity 22, as suggested in phantom lining in FIG. 2. The side wall of the receptacle 24 is tapered at about a five degree angle to fit most cold drink cups used by fast food vendors.

Non-beverage foods are placed in the holding cavity 22 where they are securely contained within easy reach of the user P. The bottom 20 of the tray portion 16 slopes downwardly at approximately a 15 degree angle in a direction away from the midportion 14 to a lowermost edge 26 at the outside end 28 of the lap tray 10. The sloping bottom helps drain any liquids spilled in the holding cavity 22 towards the outside edge of the cavity and away from both the user and any food in the cavity. The sloping bottom also inclines food packages placed in the cavity towards the hand of the user as it reaches into the cavity. In the illustrated case where the tray portion is on the right side of the user, the user's right hand will normally reach into the cavity 22. The sloping bottom inclines any food bags or containers in the cavity towards the right, so that the right hand more easily reaches into those bags or containers. The same effect is achieved if the lap tray is reversed for left hand use. The lowermost edge 26 also is first to contact the seat surface S when the midportion 14 flexes under loading of the tray portion, and supports the tray portion 16 against excessive sagging under the weight of food and drink. The tray top surface 18 may be angled so as to slope slightly upwardly from the midportion 14 towards the outer end 28, so as to maintain a generally level top surface when the tray midportion 14 bends and the tray portion 16 sags somewhat under loading.

The top surface 18 of the tray portion includes a portion 40 which extends from the holding cavity 22 to the top 19 of the midportion, i.e to about mid-thigh as seen in FIG. 2, serves as a table surface on which food items may be placed for immediate consumption, and which may also support eating utensils, napkins, and other articles which do not require containment in the cavity 22. The surface 18 may also serve as a convenient writing surface. A raised border 42, approximately ½ inch high and about ½ inch wide around the top surface 18 assists in containing spills of both food and beverages.

The lap tray 10 provides a safer and more convenient alternative to existing food trays or makeshift arrangements used by the drivers and passengers of road vehicles, both while stationary and while traveling on highways. The lap tray 10 is secure against shifting or slipping from the user's lap by virtue of being held down by the weight of one thigh of the user and also, if necessary, by clamping the rising part of the midportion 14 between the user's thighs. A further aid in holding the lap tray 10 in place is the curved underside 30 of the midportion 14 which generally conforms to the curvature of the top of the user's thigh. An important advantage of the lap tray 10 is the lateral offset of the tray portion 16, which keeps the tray to one side of the user where it does not obstruct or interfere with the driver's access to the steering wheel directly in front of him or her, nor to other operating controls on the vehicle dashboard. The lap tray 10 will be found useful in vehicles equipped with either bench or bucket seats.

It will be understood that nothing herein is intended to encourage or condone the practice of eating or drinking by a driver while operating a motor vehicle on a public roadway. Such practice can divert the driver's full attention away from the road and result in an increased risk of accident and injury. The benefits of this lap tray will be realized by a driver who consumes food or drink while seated in the driver's seat in a stationary vehicle, for example, parked at a highway rest stop or in the parking lot of a drive-through restaurant.

While the lap tray 10 is shown in the drawings with the tray portion 16 on the right hand side of the user P, the lap tray can be reversed so that the base portion 12 is held under the right thigh RT and the tray portion 16 is offset to the left side of the user P. Left hand positioning of the tray portion 16 may be suitable, for example, for a person occupying the front passenger seat of the vehicle. While the lap tray provides an advantageous alternative to carry-out food trays currently available to motorists, it should be understood that the lap tray of this invention is by no means limited to use in automotive vehicles. For example, the lap tray 10 may be used with equal benefit by spectators seated on bleachers in sports stadiums and similar venues, or at picnics and beach outings, where the novel features of this invention help keep the lap tray from accidentally slipping to the ground or being blown off the user's lap by a strong gust of wind.

It will be evident that the improvements disclosed herein do not limit the lap tray 10 to any particular tray shape or configuration. The number and disposition of holding cavities and receptacles in the tray portion 16, as well as the shape and size of the tray portion 16 can be changed and adapted to suit many uses and applications calling for a convenient, dependable and versatile lap tray. The lap tray 10 may serve, for example and without limitation, as a tool and instrument tray for technicians and mechanics, or a paint and brush tray for artists.

While a presently preferred embodiment of the invention has been described and illustrated for purposes of clarity and example, many changes, modifications and substitutions to the described embodiment will be apparent to those possessed of ordinary skill in the art without thereby departing from the scope and spirit of the invention as defined in the following claims.

What is claimed as new is:

1. A lap tray for use by a person seated on a seat surface, said lap tray comprising a base portion defining a base plane, a tray portion including a tray top supported on a midportion rising from said base, the tray portion being elevated and laterally offset in non-overlying relationship to the base portion, one or more receptacles depending from said tray top to a tray bottom near said base plane, said one or more receptacles being laterally spaced from said midportion to define a space dimensioned for receiving between said midportion and said receptacles the height and width of one thigh of the seated person so that said tray portion is supported on the one thigh while said base portion is captive under the other thigh of the seated person and against the seat surface with said midportion rising between the one thigh and the other thigh.

2. The lap tray of claim 1 wherein said midportion is curved to define a concave undersurface.

3. The lap tray of claim 2 wherein said concave undersurface extends approximately ninety degrees of arc between a lower end of said midportion and said tray top.

4. A lap tray comprising a base portion defined by relatively thin sheet material and defining a base plane, a midportion also of relatively thin sheet material, said midportion rising generally transversely to said base portion for supporting a tray portion above said base plane but in laterally offset non-overlying relationship to said base portion, said tray portion having a tray top and one or more receptacles dependent from said tray top, said receptacles being laterally spaced from said midportion by a generally planar portion of said tray portion;

wherein the vertical distance between said base plane and said tray top is generally such as to accommodate the height of a person's thigh and the lateral spacing between said midportion and the dependent receptacles is generally such as to accommodate the width of a person's thigh.

5. The lap tray of claim 4 wherein said midportion is arcuately curved with a concave underside generally facing said one or more receptacles.

6. The lap tray of claim 4 wherein said one or more receptacles depend a vertical distance which is approximately equal or little less than the vertical distance from said tray top to said base plane.

7. The lap tray of claim 4 wherein said midportion has a width dimension approximately similar to a width dimension of said tray portion.

8. The lap tray of claim 4 wherein said base portion and said midportion are defined by a continuous sheet and are joined at an approximately right angle bend of said continuous sheet.

9. A lap tray comprising a base plate, a midportion rising transversely to said base plate, and a tray portion supported at an upper end of said midportion, said base plate being entirely on one side of the midportion and said tray portion being entirely on an opposite side of said midportion such that the tray portion does not overlie the base plate, said tray portion having an underside elevated above the base plate sufficiently to admit the height of a person's thigh between said base plate and the tray underside, so that the tray portion may be supported on one thigh of a seated person while the base plate is held under another thigh of the seated person with the midportion positioned between the two thighs.

10. The lap tray of claim 9 wherein said base plate and said midportion are defined by a continuous relatively thin sheet having a width much greater than its thickness and bent at approximately a right angle to define said base plate and said midportion.

11. The lap tray of claim 9 wherein said tray portion has one or more receptacles dependent from a tray top generally level with the upper end of the midportion to a tray bottom close to a base plane defined by said base plate, said receptacles being laterally spaced from said midportion so as to depend on one side of the user's lap.

12. A lap tray for use by a person sitting on a seat surface, said lap tray comprising a first generally flat portion held only under one of two thighs of the person, a second portion connected to said first portion and generally upright between two thighs of the person, and a third portion connected to said second portion and overlying only the other of the two thighs of the person, said third portion extending laterally to an outer side of the said other of the two thighs such that a substantial portion of said third portion extends to one side of the person.

13. The lap tray of claim 12 further comprising one or more receptacles dependent from said substantial portion of the third portion, whereby the receptacles are supported generally laterally of the person's thighs thereby to keep clear the lap of the person.

14. The lap tray of claim 1 wherein said base portion is generally planar.

15. The lap tray of claim 1 wherein said midportion generally conforms to the curvature of said other thigh.

16. The lap tray of claim 1 wherein said midportion has a concavely curved underside generally facing towards said one or more receptacles and away from said base portion.

17. The lap tray of claim 16 wherein said underside includes a generally cylindrical curvature.

18. The lap tray of claim 1 wherein said one or more receptacles comprise at least one beverage container receptacle.

19. The lap tray of claim 18 wherein said one or more receptacles comprise a holding cavity larger than said beverage container receptacle, said holding cavity being adjacent to said receptacle, said beverage container receptacle being partly open to said holding cavity such that a beverage container with a handle may be placed in said receptacle with the handle extending into said holding cavity.

20. The lap tray of claim 1 wherein said base portion, said midportion and said tray portion are all unitary with each other.

21. The lap tray of claim 1 wherein in an unloaded condition of said tray portion said tray bottom hangs a relatively small height above said base plane.

22. The lap tray of claim 21 wherein said tray bottom has an outer side distal to said midportion, said outer side comprising a lowermost portion of said tray portion normally above said base plane in said unloaded condition, such that in a loaded condition of said tray Portion said midportion may flex and said lowermost portion may rest on the said seat surface.

* * * * *